US012662837B1

(12) United States Patent
Galindo

(10) Patent No.: US 12,662,837 B1
(45) Date of Patent: Jun. 23, 2026

(54) ROOF OVERHANG FOR ABOVE GROUND SHELTER

(71) Applicant: Steve Galindo, Tulsa, OK (US)

(72) Inventor: Steve Galindo, Tulsa, OK (US)

( * ) Notice: Subject to any disclaimer, the term of this patent is extended or adjusted under 35 U.S.C. 154(b) by 232 days.

(21) Appl. No.: 18/428,625

(22) Filed: Jan. 31, 2024

(51) Int. Cl.

| | |
|---|---|
| ***E04H 9/14*** | (2006.01) |
| ***E04B 1/16*** | (2006.01) |
| ***E04B 1/35*** | (2006.01) |
| ***E04G 11/02*** | (2006.01) |
| ***E04G 11/06*** | (2006.01) |
| *E04G 11/36* | (2006.01) |
| *E04G 11/38* | (2006.01) |

(52) U.S. Cl.
CPC ..... *E04H 9/14* (2013.01); *E04B 1/16* (2013.01); *E04B 1/3505* (2013.01); *E04G 11/02* (2013.01); *E04G 11/06* (2013.01); *E04G 11/36* (2013.01); *E04G 11/38* (2013.01)

(58) Field of Classification Search
CPC ..... E04G 11/00; E04G 11/02; E04G 11/06; E04G 11/36; E04G 11/38; E04B 1/16; E04B 1/3505; E04H 9/14
See application file for complete search history.

(56) References Cited

U.S. PATENT DOCUMENTS 3,089,217 A * 5/1963 Filippi ..... E04G 11/04 425/468
3,490,729 A * 1/1970 Hiller ..... E04G 11/02 249/35
3,512,316 A 5/1970 Parr
3,669,401 A * 6/1972 Nevarez ..... E04G 9/05 425/117
3,847,341 A * 11/1974 Stickler, Jr. ..... E04B 1/162 249/185
3,898,776 A * 8/1975 Cox ..... E04B 1/34823 52/79.14
4,214,408 A * 7/1980 Rich, Jr. ..... B28B 7/22 52/252
4,226,061 A * 10/1980 Day, Jr. ..... E04B 2/8652 52/378

(Continued)

OTHER PUBLICATIONS

Galindo, Abandoned U.S. Appl. No. 15/276,685 by Steve Galindo filed Sep. 26, 2016; not published.

*Primary Examiner* — Paola Agudelo
(74) *Attorney, Agent, or Firm* — James B. Lea, III; Gable Gotwals

(57) ABSTRACT

A shelter construction assembly includes a roof bracket for locating above concrete forms for forming a roof overhang of the concrete shelter. The roof bracket defines a topping member and an internal downwardly extending portion, wherein the topping member is located on an upper surface of an outside form. The internal downwardly extending portion is located adjacent to an inside facing surface of the outside form. The roof bracket may have an external downwardly extending portion for locating adjacent to an outside surface of the outside form. At least one fastener, such as a snap tie, spans between the outside surface of the outside form and the inside facing surface of the inside form and may pass through the internal downwardly extending portion of the roof bracket. Poured concrete is retained above a ceiling form by an external upwardly extending portion of the roof bracket for forming the roof overhang.

11 Claims, 19 Drawing Sheets

(56) References Cited

U.S. PATENT DOCUMENTS 4,726,560 A * 2/1988 Dotson ..... E04G 17/0714 249/46
4,787,181 A 11/1988 Witten et al.
5,088,578 A * 2/1992 Gates ..... E04G 11/06 249/20
5,123,874 A 6/1992 White, III
5,224,315 A 7/1993 Winter, IV
5,338,498 A * 8/1994 Lefebvre ..... E04G 11/02 249/161
5,376,315 A * 12/1994 Fricke ..... E04H 9/14 264/275
6,349,873 B1 * 2/2002 Slater ..... B65D 90/028 220/651
6,643,981 B2 * 11/2003 Pina ..... E04D 13/0641 52/90.2
6,948,281 B1 9/2005 Carmichael
7,409,801 B2 * 8/2008 Pfeiffer ..... E04B 2/8635 52/592.2
8,534,001 B2 9/2013 Scott, IV
8,621,790 B2 1/2014 Lekhtman
9,797,153 B2 10/2017 Baggiero, II et al.
10,240,337 B2 3/2019 Evert
10,584,509 B1 3/2020 Zagorski
10,597,881 B1 * 3/2020 Huguet, Sr. ..... E04C 2/06
11,242,693 B1 * 2/2022 Galindo ..... E04B 1/08
11,859,404 B2 1/2024 Yano
2002/0174606 A1 11/2002 Hunt
2003/0075285 A1 4/2003 Anderson et al.
2003/0126805 A1 7/2003 Roberts
2005/0284035 A1 12/2005 DeOvando et al.
2006/0185260 A1 8/2006 Dehart
2008/0307725 A1 * 12/2008 Trimmer ..... E04G 17/16 52/261
2009/0004430 A1 1/2009 Cummins et al.
2009/0217600 A1 9/2009 De Azambuja
2010/0043309 A1 2/2010 Martin et al.
2010/0050556 A1 3/2010 Burns
2012/0222367 A1 9/2012 Wirtz
2013/0019542 A1 1/2013 Bishop
2014/0259976 A1 9/2014 Bowers et al.
2015/0068466 A1 3/2015 Piccioni
2015/0096478 A1 4/2015 Magiera
2015/0308135 A1 10/2015 Athanasiou et al.
2017/0211268 A1 7/2017 Eichhorn et al.
2019/0226218 A1 * 7/2019 Hieb ..... E04G 11/085
2022/0228384 A1 * 7/2022 White ..... E04G 21/185

* cited by examiner

1. CONCRETE FOUNDATION OR FLOOR BY OTHERS
2. TRIM OUT VERTICAL LEG OF BASE FOR DOORS
3. DOORS BEYOND
4. CONCRETE FILLED WALL
5. CONCRETE FILLED WALL BEYOND
6. CONCRETE FILLED ATTIC
7. 4"x3"x1/4" STEEL ANGLE RAFTERS @ 42" ON CENTERS
8. SHORED UP 3/4" PLYWOOD CONCRETE FORMS
9. 1/2" STEEL ROD SLIDE LATCH

1 CONCRETE FOUNDATION OR FLOOR BY OTHERS
2 TRIM OUT VERTICAL LEG OF BASE FOR DOORS
3 DOORS BEYDOORS PAIRED RE: DETAIL 2
4 CONCRETE FILLED WALL
5 CONCRETE FILLED ATTIC
6 4"x3"x1/4" STEEL ANGLE RAFTERS @ 42" ON CENTERS
7 SHEET METAL CORNER TRIM

1 CONCRETE FOUNDATION OR FLOOR BY OTHERS
2 SHEET METAL CORNER TRIM
3 CONCRETE FILLED WALL
4 CONCRETE FILLED ATTIC
5 4"x3"x1/4" STEEL ANGLE RAFTERS @ 42" ON CENTERS
6 VENT OPENING
7 3"x3"x1/4" STEEL ANGLE SILL

ROOF OVERHANG FOR ABOVE GROUND SHELTER

FIELD OF THE INVENTION

This application relates generally to structures, and more particularly to a monolithic tornado shelter that can be easily installed in or around a finished building such as a home or school. More particularly, the application relates to a shelter construction assembly and method of forming a roof overhang on a structure.

BACKGROUND OF THE INVENTION

Tornados kill dozens of people in the United States alone each year. They can arise suddenly and with extreme violence, making it difficult or impossible for many to seek community shelter. Hardened tornado shelters are typically expensive and require extensive construction, permits and significant money. Tornado shelters may also be unavailable for existing homes with a small yard for the same reasons. What is needed is a robust and affordable tornado shelter that can be easily installed in a garage or on a concrete pad near a home with minimal skill and expense required.

SUMMARY OF THE INVENTION

A tornado shelter is described herein. The tornado shelter has a base that defines four sides, four corners and a center. A plurality of rods, such as rebar, extend upwardly from each of the four sides. The rods may be welded to the base.

Walls extend upwardly from each of the four sides of the base. An upper portion of the rods extend above a top surface of each of the walls. The upper portion of each of said rods are bent towards said center of the base for strengthening a ceiling portion of the shelter. The rods located inside each of the walls and the upper portion of the rods inside said ceiling portion are encased in a monolithic concrete member resulting from a single pour.

A door is preferably provided within a door opening formed in at least one of the walls. A conduit may be provided within at least one of the walls and the ceiling portion. An orifice may be provided within at least one of the walls for air ventilation. A bench may be affixed to the base.

The tornado shelter may be constructed by placing the base at a desired location. The base provided with an outer angle iron extending upwardly at each of said four corners and an inner angle iron extending upwardly at each of the four corners. The vertical rods are affixed to the base. An inside concrete form is placed adjacent to the inner angle iron and an outside concrete form is placed adjacent to the outer angle iron. The vertical rods are between the inside concrete form and said outside concrete form. A top ceiling form is placed on a top surface of the inside concrete form. An upper portion of the rods that extend above the top surface of the inside concrete form and the outside concrete form are bent towards the center of the base. A single pour of concrete is poured for filling a space between the inside concrete form and the outside concrete form and for covering the upper portion of the rods above the top ceiling form.

After the concrete cures, the inside concrete form, the outside concrete form and the top ceiling form may be removed. A door may be hingedly affixed in a door opening in one of the walls. A conduit may be placed in between the inside and outside concrete forms and above the ceiling form. Vents may be formed in at least one of the walls. A bench may be affixed to the base.

Tornado shelters are disclosed that are made from a monolithic steel frame welded together onsite or in a factory and then transported to the shelter location where concrete is poured into the frame creating a robust, durable, and safe shelter.

In one embodiment, a channel, such as a steel channel is placed for a base in a square or rectangular configuration. In a preferred embodiment, the channel is 6" in width.

An angle iron is vertically affixed at an inside corner and an outside corner at each corner of the base. In a preferred embodiment, the angle iron and rebar are welded to the base. In a preferred embodiment, the rebar is 10' in length. The upper 4' of the rebar is bent towards the inside of the building for strength.

Inside forms and outside forms are placed adjacent to the vertical angle iron and rebar. A top ceiling form is placed on a top surface of the inside forms. The rebar is further bent to the center of the structure over the top panel.

A single pour of cement is poured to deliver concrete between the inside forms and outside forms and above the top ceiling form. The inside forms and the ceiling form is removed after the cement has cured.

A door is constructed with square tubing. The door preferably has steel skin on both sides. The door components will be layered and welded to a flat area in front to the doorway framed wall channel. All of the door structure is welded together for strength. Preferably, the door will swing to the inside and will be provided with two cross-door latch bars to lock the door in place.

In a preferred embodiment, the units will have conduit located in the walls for future electric installations. Additionally, the unit is preferably provided with two 4" by 16" orifices for air ventilation. The unit is preferably provided with two welded benches located in the unit.

In another aspect of the invention, a shelter construction assembly includes an outside form having an inside facing surface, an outside surface, and an upper surface. The shelter construction assembly further includes a roof bracket defining a topping member and an internal downwardly extending portion, wherein the topping member is located on the upper surface of the outside form, the internal downwardly extending portion adjacent to the inside facing surface of the outside form. A second outside form is provided, e.g., for forming a corner of the structure. The second outside form has an upper surface. The second outside form may contact the outside form to create a corner.

In one embodiment, the roof bracket further has an external downwardly extending portion extending from the topping member, the external downwardly extending portion adjacent to the outside surface of the outside form. In one embodiment, the roof bracket has a first section that covers a length of the upper surface of the outside form. The roof bracket may additionally have a second section that covers a length of the upper surface of the second outside form, the roof bracket forming a roof bracket corner coinciding with the corner.

Preferably, an inside form is located adjacent to the outside form. The inside form has an inside facing surface, an outside facing surface, and an upper surface.

At least one fastener spans between the outside surface of the outside form and the inside facing surface of the inside form. In one embodiment, the fastener passes through the internal downwardly extending portion of the roof bracket. In one embodiment, the fastener is a snap tie.

In practice, a roof overhang of a shelter may be constructed by the following steps. Erecting an inside concrete form is erected. The inside concrete form has an inner surface, an outside facing surface, and an upper surface. Erecting an outside concrete form adjacent to the inside concrete form, the outside concrete form having an inner facing surface, an outer surface, and an upper surface. The inner surface of the inside concrete form and the inner facing surface of the outside concrete form define an space therebetween.

A roof bracket is located on the upper surface of the outside concrete form. The roof bracket defines a topping member, an external upwardly extending portion affixed to the topping member and an internal downwardly extending portion affixed to the topping member. The topping member of the roof bracket is located on the upper surface of the outside concrete form and the internal downwardly extending portion is located adjacent to the inner facing surface of the outside concrete form.

A top ceiling form is located adjacent to the upper surface of the inside concrete form. The top ceiling form defines an upper surface.

Concrete is poured on the upper surface of the top ceiling form. The concrete is retained with the external upwardly extending portion of the roof bracket for forming the roof overhang.

In one embodiment, the roof bracket defines an external downwardly extending portion, the external downwardly extending portion extending from the topping member of the roof bracket, the external downwardly extending portion positioned adjacent to the outer surface of the outside concrete form.

In one embodiment a fastener is installed though the inside concrete form and the outside concrete form. In one embodiment, the step of installing the fastener includes passing the fastener through the internal downwardly extending portion of the roof bracket. In one embodiment, the fastener is a snap tic.

DETAILED DESCRIPTION OF THE PREFERRED EMBODIMENTS

The following description supplies specific details in order to provide a thorough understanding. Nevertheless, the skilled artisan would understand that embodiments of tornado shelter frames and associated methods of using them can be implemented and used without employing these specific details. Indeed, exemplary embodiments and associated methods can be placed into practice by modifying the illustrated units and associated methods and can be used in conjunction with any other devices and techniques conventionally used in the industry. For example, while the description below generally focuses on an embodiment with a complete frame constructed prior to transportation, the frame may be formed in panels or sections prior to final welding and assembly on site.

One exemplary embodiment of a monolithic tornado shelter frame (shelter) 100 is illustrated in FIGS. 1-6. Shelter 100 may include frame 110, base 120, and roof 130. Frame 110, base 120, and roof 130 may be formed from steel and welded together to form a monolithic shelter frame 100. Frame 110 may be formed (as illustrated) of angle iron welded together to form a skeleton that may then be formed up with concrete to finish the walls and ceiling. Shelter 100 may be installed inside of a garage, on a back porch or on some other concrete surface to provide a stable foundation. The shelter may be stocked with supplies for an emergency, leaving enough room for people and pets to comfortably and safely ride out a tornado.

Figure 1:
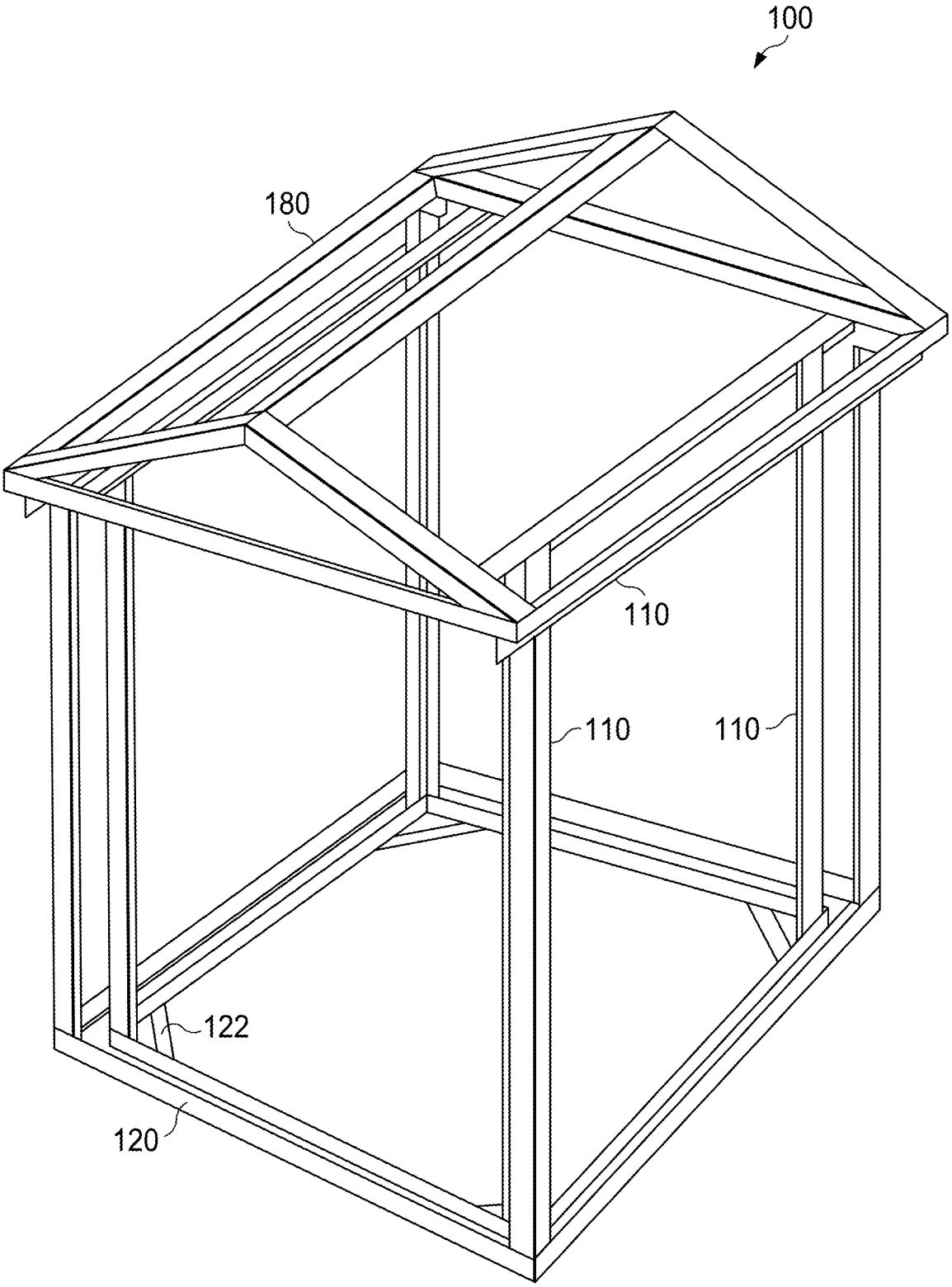
FIG. 1 is a drawing of an exemplary monolithic tornado shelter frame prior to door and vent installation.
Figure 2:
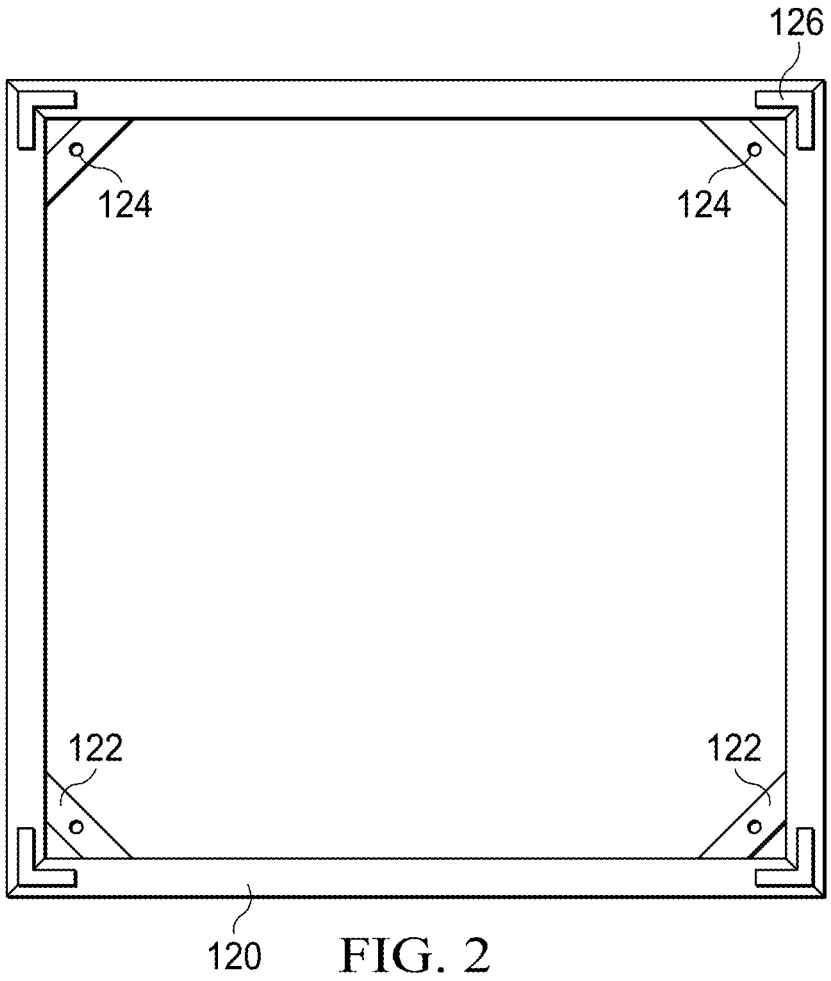
FIG. 2 is a top view of a base of an exemplary monolithic tornado shelter frame.

Turning to FIG. 2, base 120 may include a periphery formed from channel steel to provide a bottom support for the concrete and a strong base for the tornado shelter. The channel steel may be selected to form a desired thickness of wall depending on the size of the shelter and the desired strength. For example, 6×3×⅜ inch channel steel may be selected for a structure with six inch thick walls and strong crush resistance. The channel steel may be welded together at the corners to form a monolithic steel base for shelter 100. Corner braces 122 may be welded into the comers to provide anchor points 124 to secure base 120 and shelter 100 to a concrete floor or pad. Each corner may further include reinforcing braces 126 to further strengthen base 120.

Figure 3:
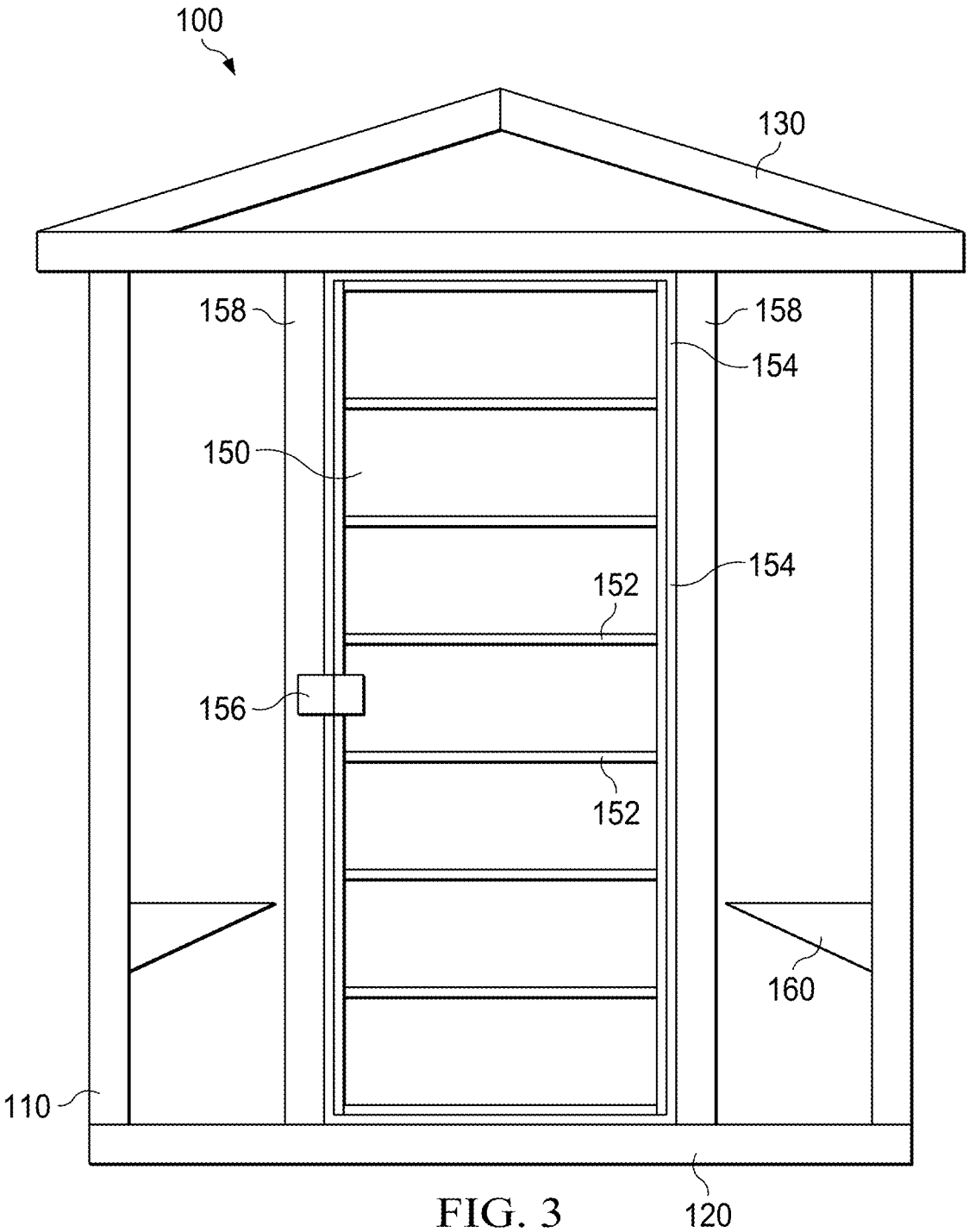
FIG. 3 is a front view of an exemplary monolithic tornado shelter frame with a door and door jamb installed.

Turning to FIG. 3, shelter 100 may include door 150 and benches 160. Door 150 may be formed from 1"×⅜" tube steel (or other suitable sized steel) body welded in a ladder formation and with a sheet steel skin on the outside or on both the outside and inside to resist damage from flying debris. Door 150 may be secured to shelter 100 between door frame pillars 158 formed of channel steel and welded to frame 110, base 120 and roof 130. Door 150 may be attached with strong hinges 154 and latch 156. Hinges 154 and latch 156 may be any strong and durable hinges and latches sufficient to withstand wind and debris damage that a tornado and collapsing home might inflict on door 150.

Roof or ceiling 130 may have a slight pitch and overhang from welding angle iron to each other to form the overhang and basic roof structure. The overhang will depend on the size of angle iron used and placed as desired. Roof 130 also includes a ridge that may be formed by welding angle iron together. It is important to note that structure 100 is made very strong by welding all structural components of shelter frame 100 together. Frame 110 may be formed using angle iron welded into the corners of base 120 and then welding to top plates of angle iron to form a structure for a poured concrete ceiling and roof within frame member of roof 130.

Figure 4:
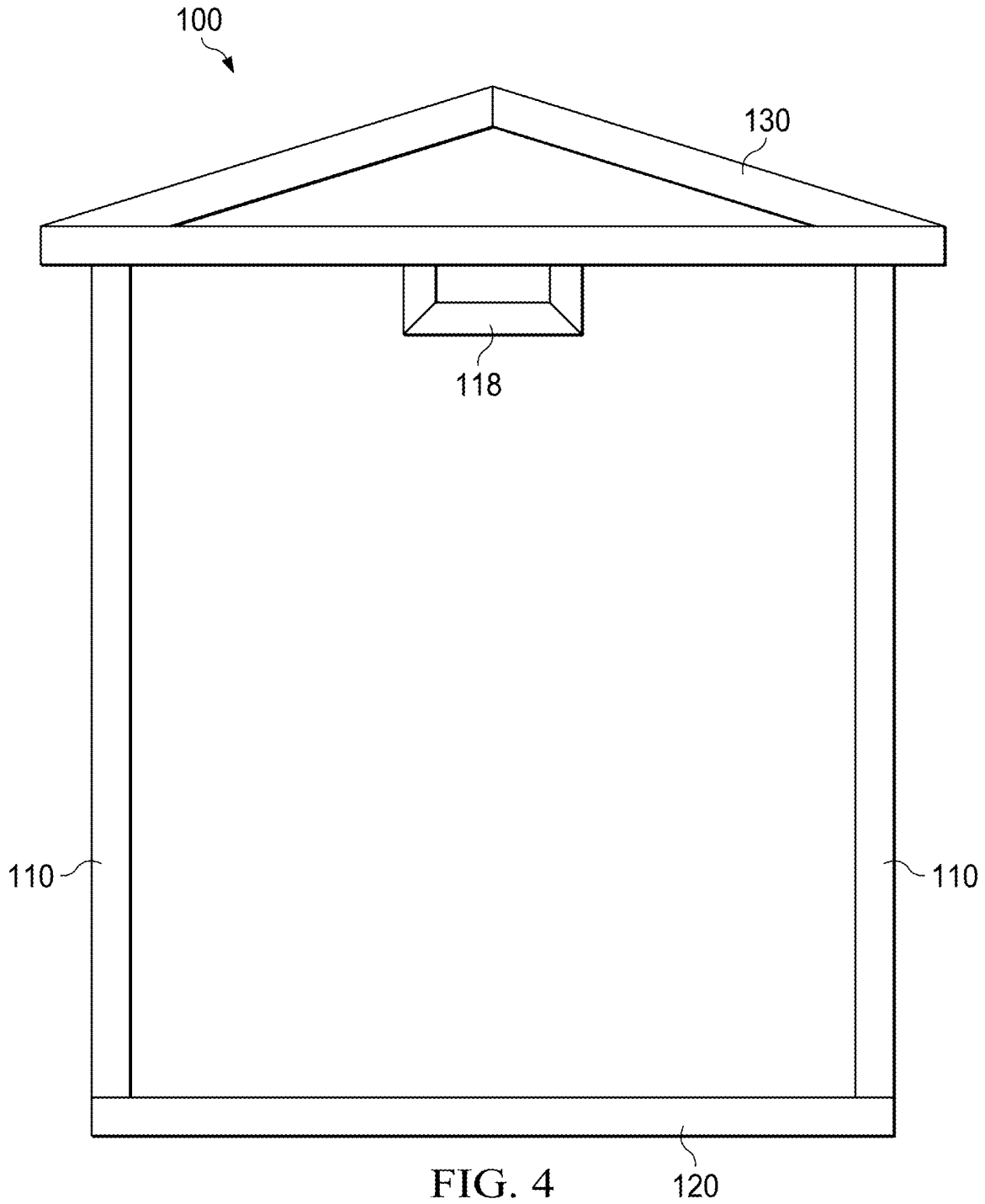
FIG. 4 is a back view of an exemplary monolithic tornado shelter frame with a pressure vent.

As shown in FIG. 4, a small pressure vent 118 may be included in a side or back of shelter 100. The vent 118 may be formed from angle iron welded to the top plate and under the overhang to prevent blockage and debris from harming people inside of the shelter in an emergency. Preferably, vent 118 and surrounding structure are of sufficient strength that the vent opening can be used as lift points for facilitating relocation of shelter 100.

Figure 5A:
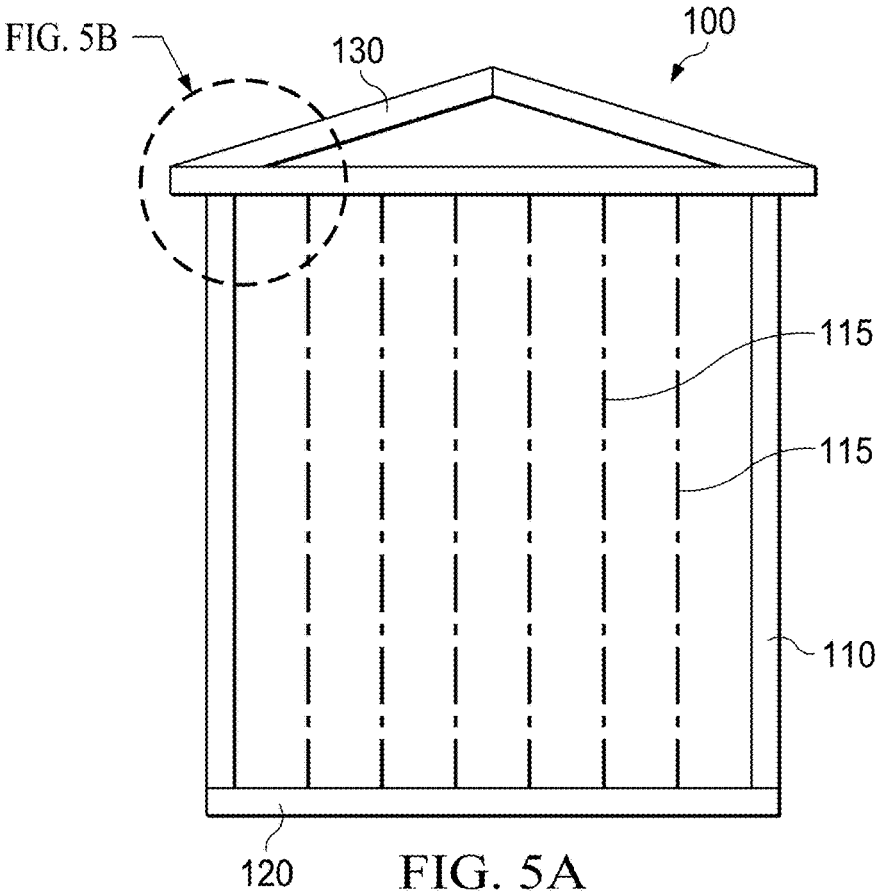
FIG. 5A illustrates rebar placement in the walls and ceiling of an exemplary monolithic tornado shelter frame to effectively tie the steel frame to the concrete.
Figure 5B:
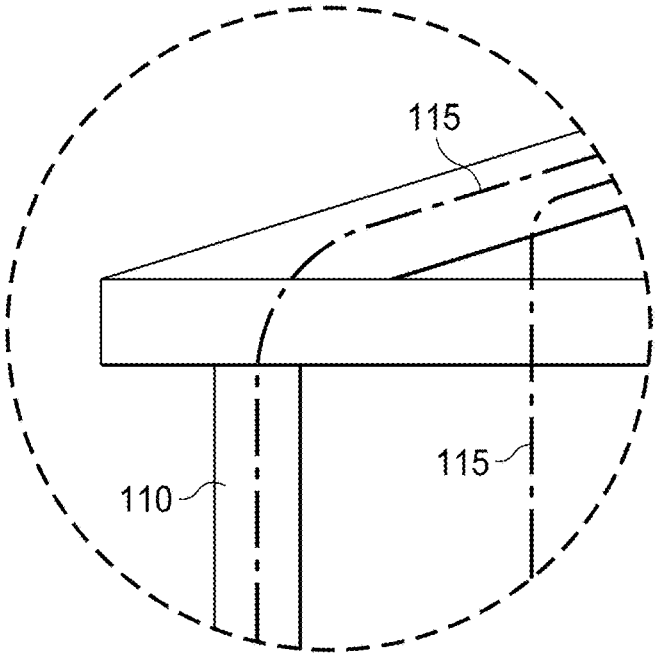
FIG. 5B illustrates an enlarged view of rebar placement in the walls and ceiling of the exemplary monolithic tornado shelter frame of FIG. 5A to effectively tie the steel frame to the concrete.
Figure 6:
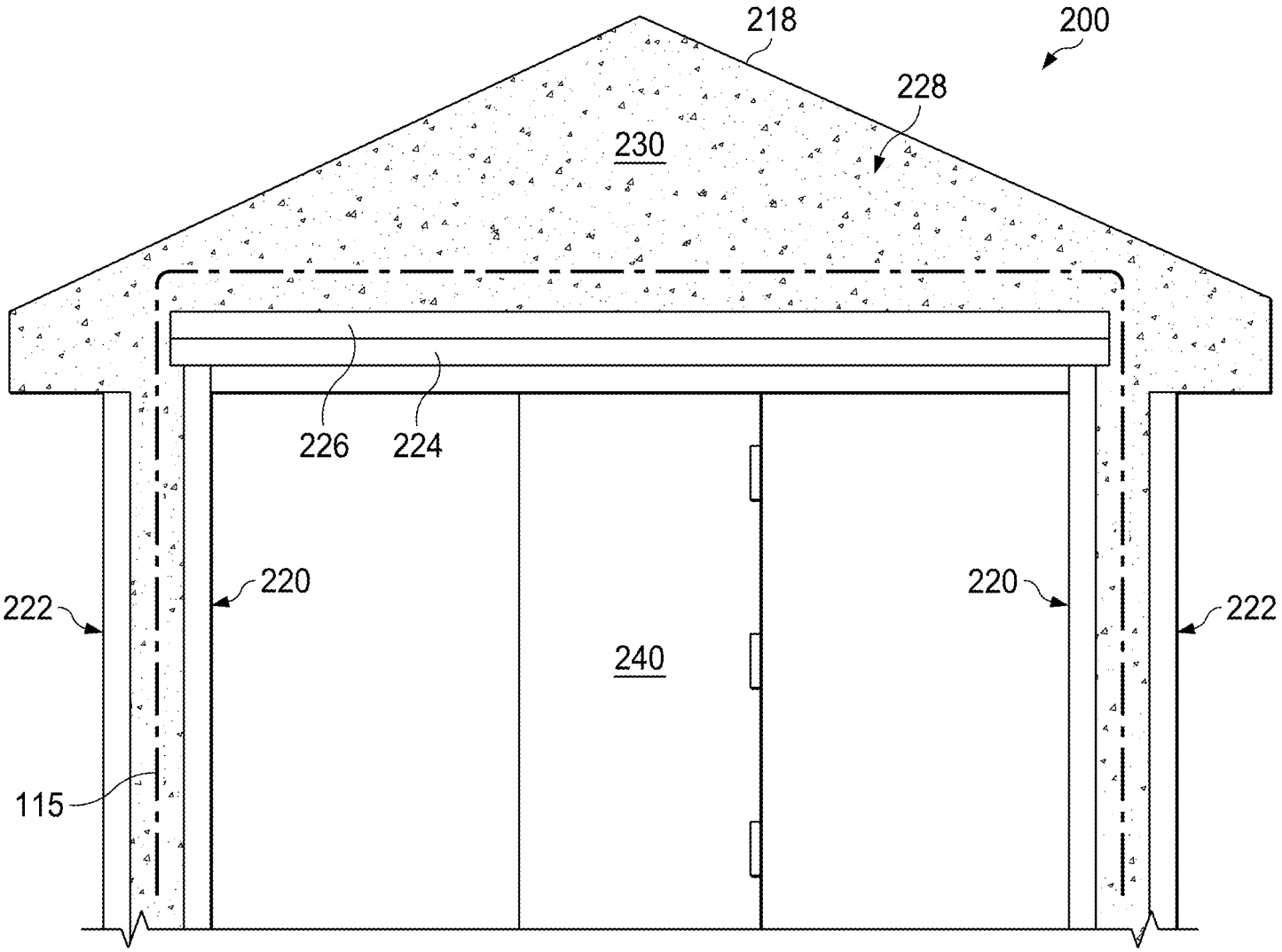
FIG. 6 is an elevation view of an exemplary tornado shelter showing support beams in a ceiling portion of the shelter.

FIGS. 5A and 5B illustrate rebar reinforcement 115 placed within frame 110 and roof 130. The rebar 115 may be bent so that it is continuous from poured concrete walls and into the poured concrete ceiling. The rebar 115 may be welded to base 120, tied to frame ties used in the concrete forms, or may include horizontal rebar (not shown) tied in to achieve high strength in the final steel and concrete structure.

In some embodiments, a shelter frame such as is shown in the figures may be manufactured in a factory to avail cheaper labor and faster manufacturing. The frame may then be loaded onto a truck and placed at the desired location. The sizes of tornado shelter frames may be selected to fit inside of average garages and could be rolled into the garage under the garage door with dolly wheels, making installation fairly easy and without requiring structural modification and expensive building permits. The shelter 100 may be less than 7 feet tall to accommodate garages, under patios, etc.

Once in place, base 120 may be secured to the floor and concrete forms may be put into place and concrete poured to fill the walls and ceiling using conventional methods such as concrete pumps to allow the tornado shelter to be finally installed. Using this method, many homes may have tornado shelters that in the past may have cost lives.

Referring now to FIGS. 6-15, a tornado shelter 200 is disclosed that is made from a monolithic steel frame welded together onsite, or in a factory and then transported to the shelter location where concrete is poured into the frame creating a robust, durable, and safe shelter.

In one embodiment, tornado shelter 200 has base 210 defining sides, corners and a center. A plurality of rods 216 extending upwardly from each of the sides. A plurality of walls include walls that extend upwardly from each of the sides. Each of the walls have a top surface, the plurality of walls include at least a first wall and a second wall.

Roof structure 218 is supported on the top surface of the first wall and the top surface of the second wall. Support beams 226 span from the top surface of the first wall to the top surface of the second wall. Roof structure 218 and support beams 226 define attic space 228 therebetween. Concrete 230 fills attic space 228 and encase support beams 226. Support beams 226 add strength, which may be necessary to support concrete 230 in attic space 228. In one embodiment support beams 226 are encased in concrete 230 and form a part of a ceiling portion. In embodiment, a plurality of support beams 226 are used, e.g., two support beams 226 divide the ceiling portion into three sections. Support beams 226 are preferably at the same height as the ceiling portion.

Rods 216 extend upwardly from each of the sides. In one embodiment rods 216 are rebar. In one embodiment, rods 216 are welded to base 202. An upper portion of rods 216 extends above the top surface of each of the walls. The upper portion of each of rods 216 above the top surface of each of the walls are bent towards the center of base 210 and above support beams 226 for strengthening shelter 200. Door 240 is received in a door opening of one of the walls. In one embodiment, at least one of said walls and said ceiling portion define a conduit. In one embodiment, at least one of the walls define an orifice for air ventilation. In one embodiment, tornado shelter 200 includes a bench affixed to base 210.

In one embodiment, base channel 202 (FIG. 7), such as steel channel, comprise base assembly 210 in a square or rectangular configuration. In a preferred embodiment, the base channel 202 channel is 6" in width.

Figure 7:
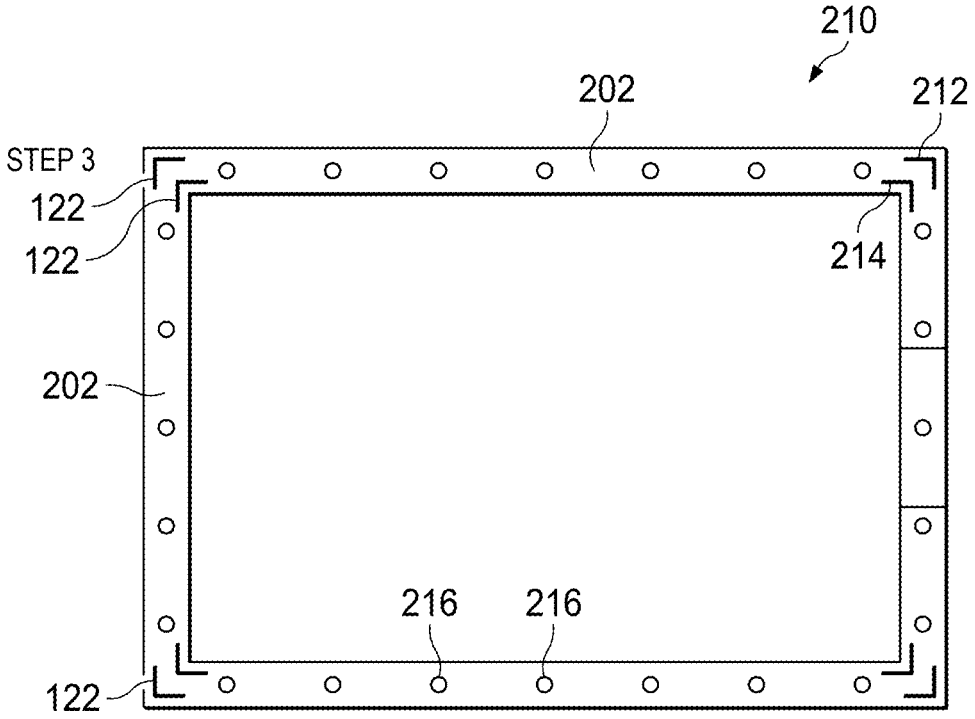
FIG. 7 is a plan view of a base of a second embodiment of a tornado shelter of the invention.
Figure 8:
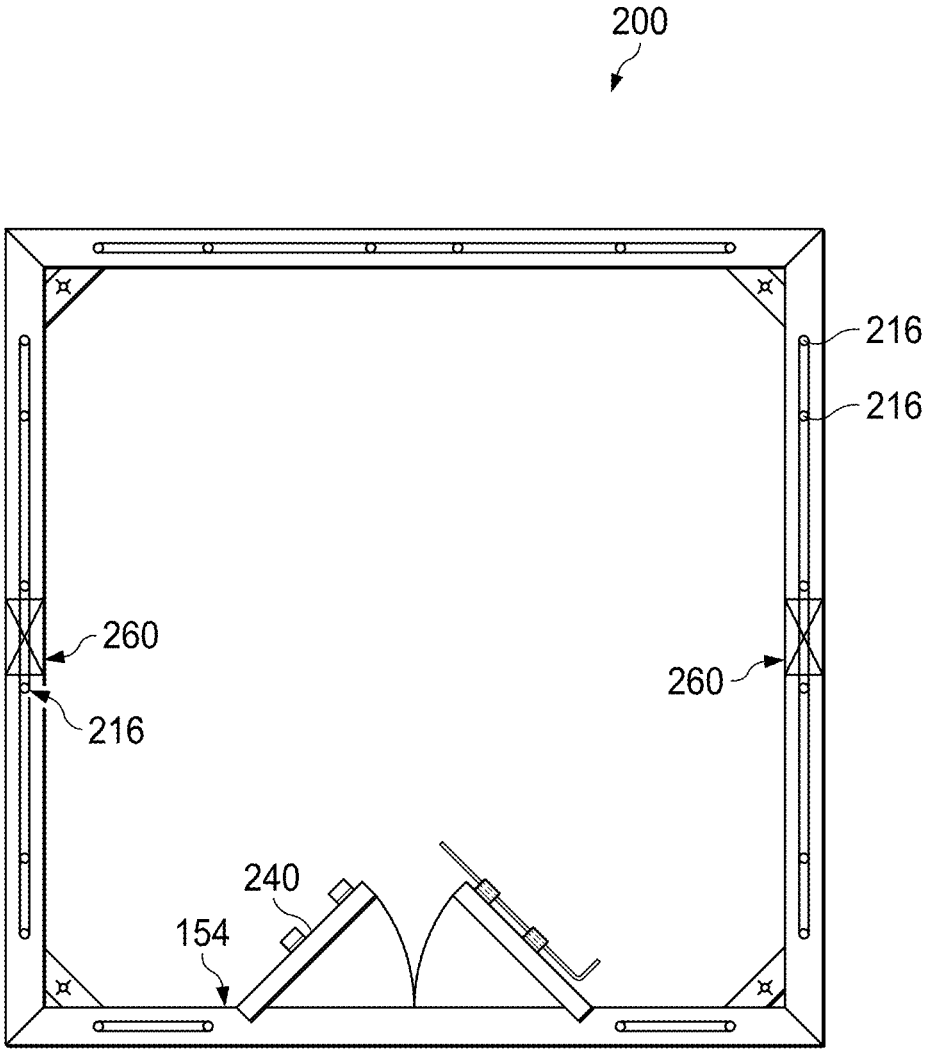
FIG. 8 is a plan view of the walls and door of the tornado shelter of FIG. 7.
Figure 14:
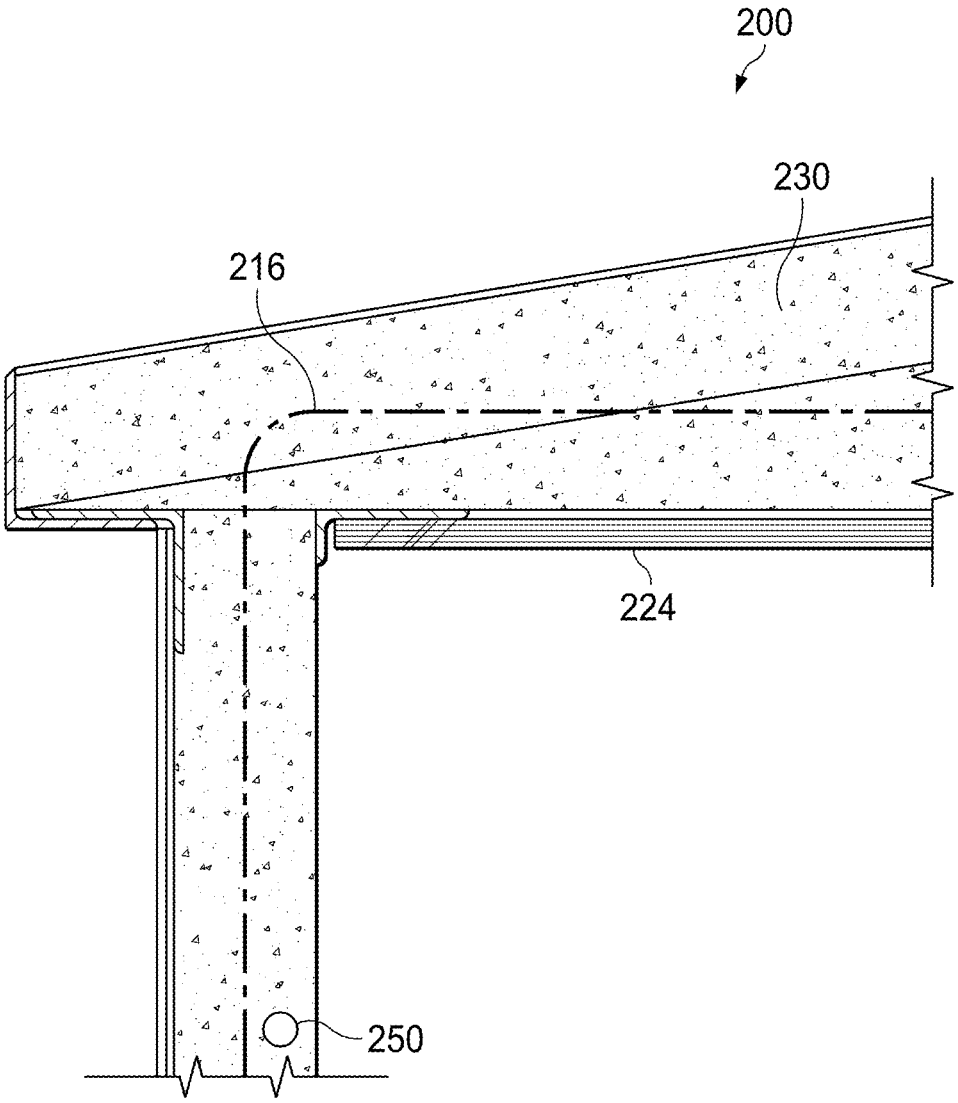
FIG. 14 is an enlarged cross sectional elevation view of an interface between a ceiling portion and a wall with bent rebar shown encased therein.

Still referring to FIG. 7, outer angle iron 212 is vertically affixed at an outside corner at each corner of base assembly 210. Inner angle iron 214 is vertically affixed at an inside corner at each corner of base assembly 210. Rebar 216 is vertically affixed to base channel 212 of base assembly 210. In a preferred embodiment, angle iron 212, 214 and rebar 216 are welded to base assembly 210. In a preferred embodiment, rebar 216 is 10' in length. As best seen in FIG. 14, the upper 4' of rebar 216 is bent towards the inside of the shelter 200 for strength.

Figure 9:
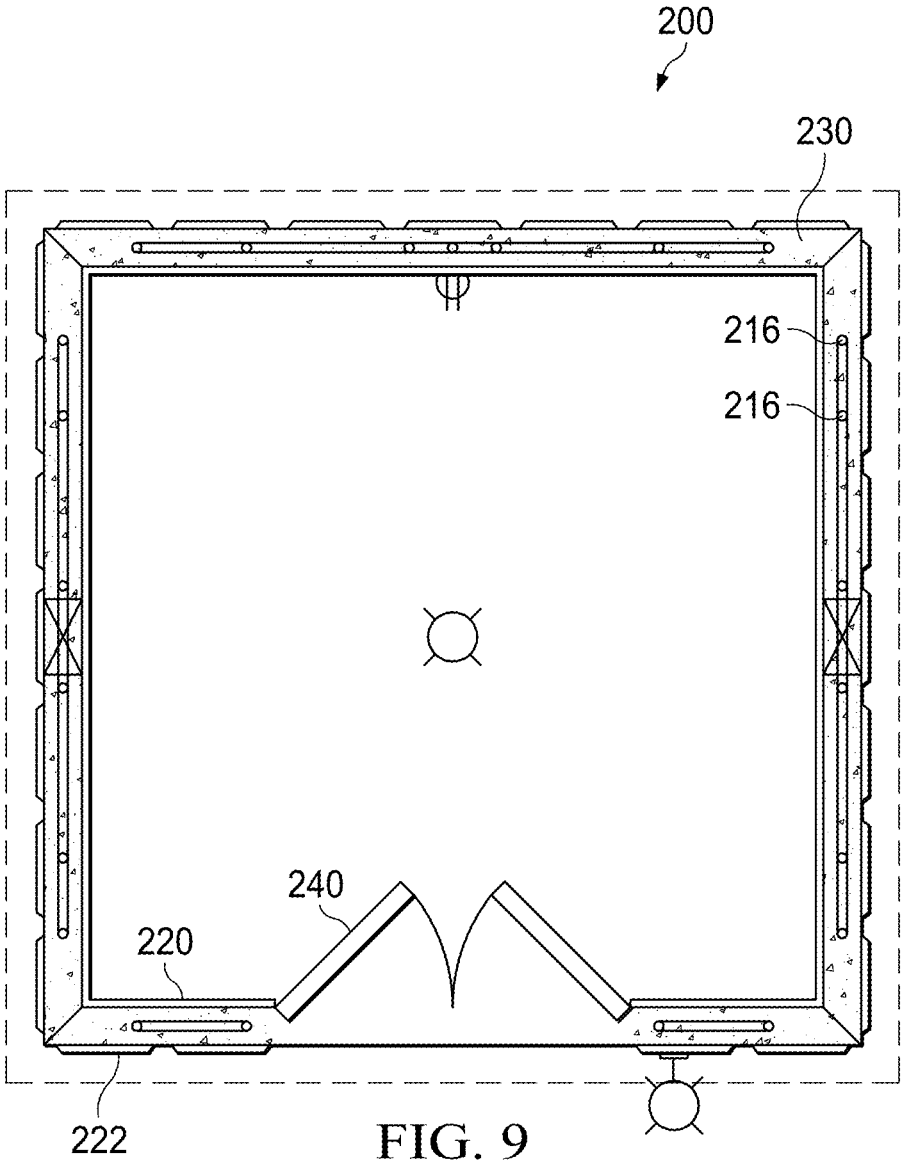
FIG. 9 is a cross section of the plan view of FIG. 8 showing openings and electrical conduit.
Figure 10:
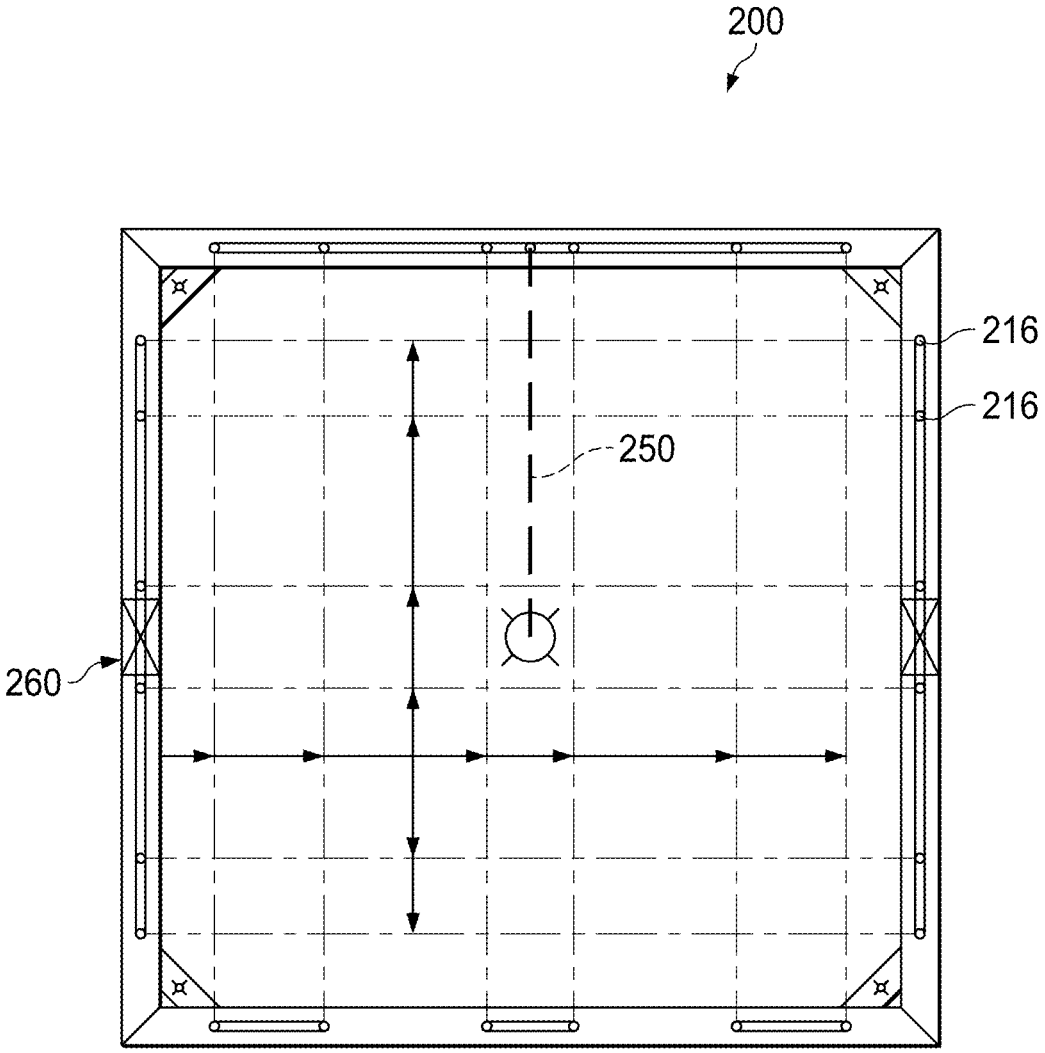
FIG. 10 is a plan view of the shelter of FIG. 7 showing the ceiling and electrical conduit.
Figure 11:
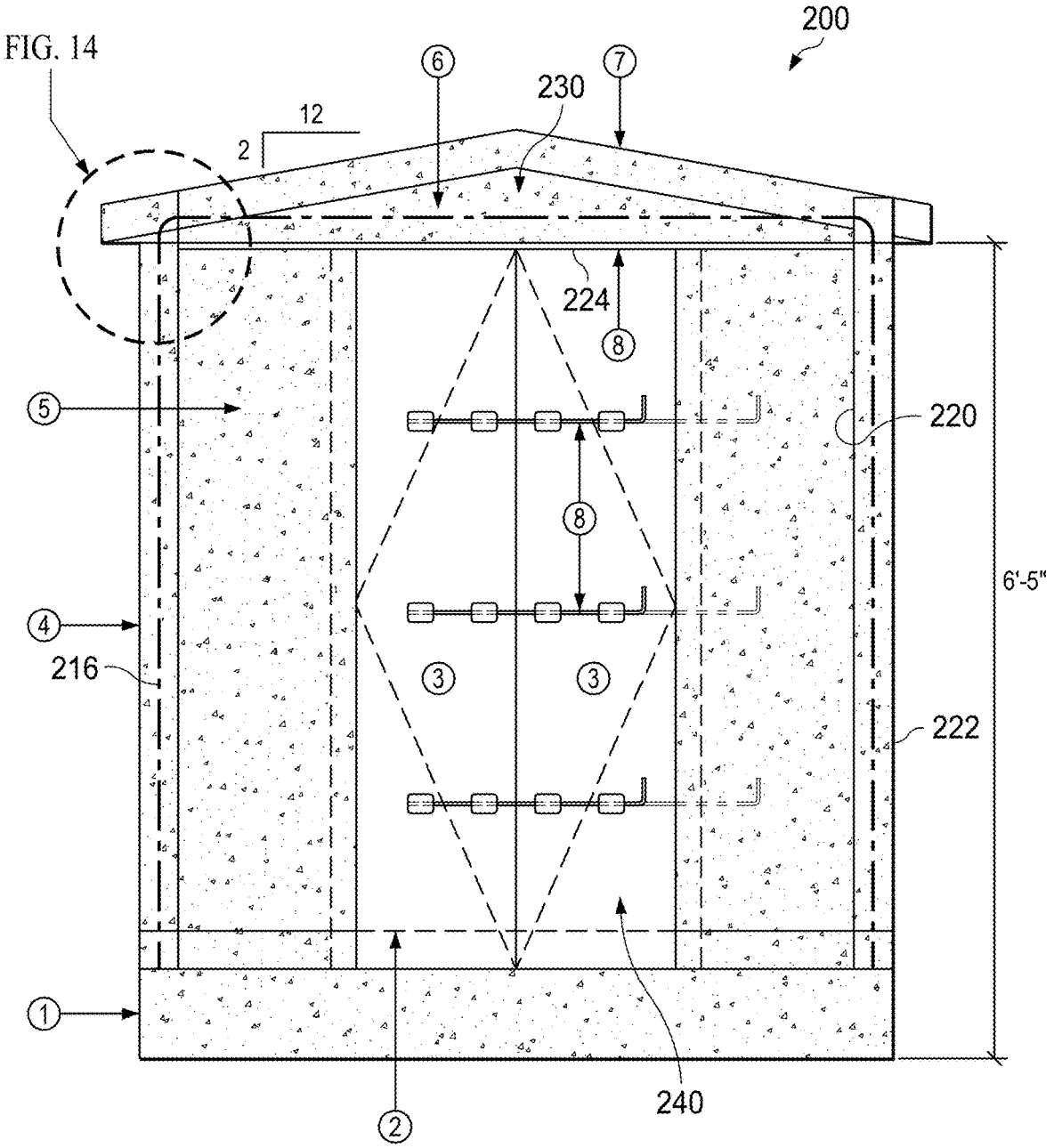
FIG. 11 is an elevation view of the shelter of FIG. 7 showing a wall with a door opening.
Figure 12:
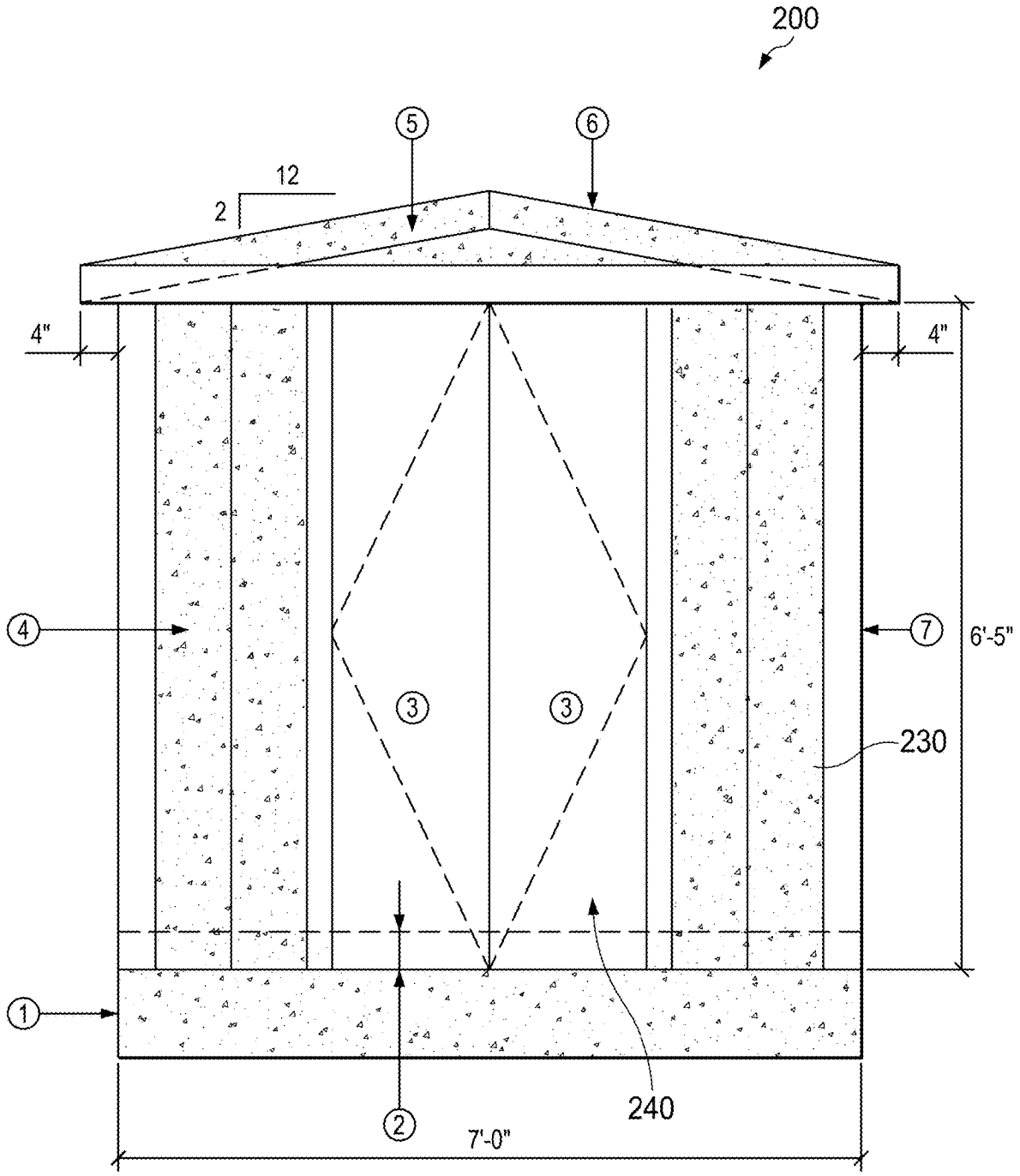
FIG. 12 is an elevation view of the shelter of FIG. 7 showing a wall with a door opening and door installed therein.
Figure 13:
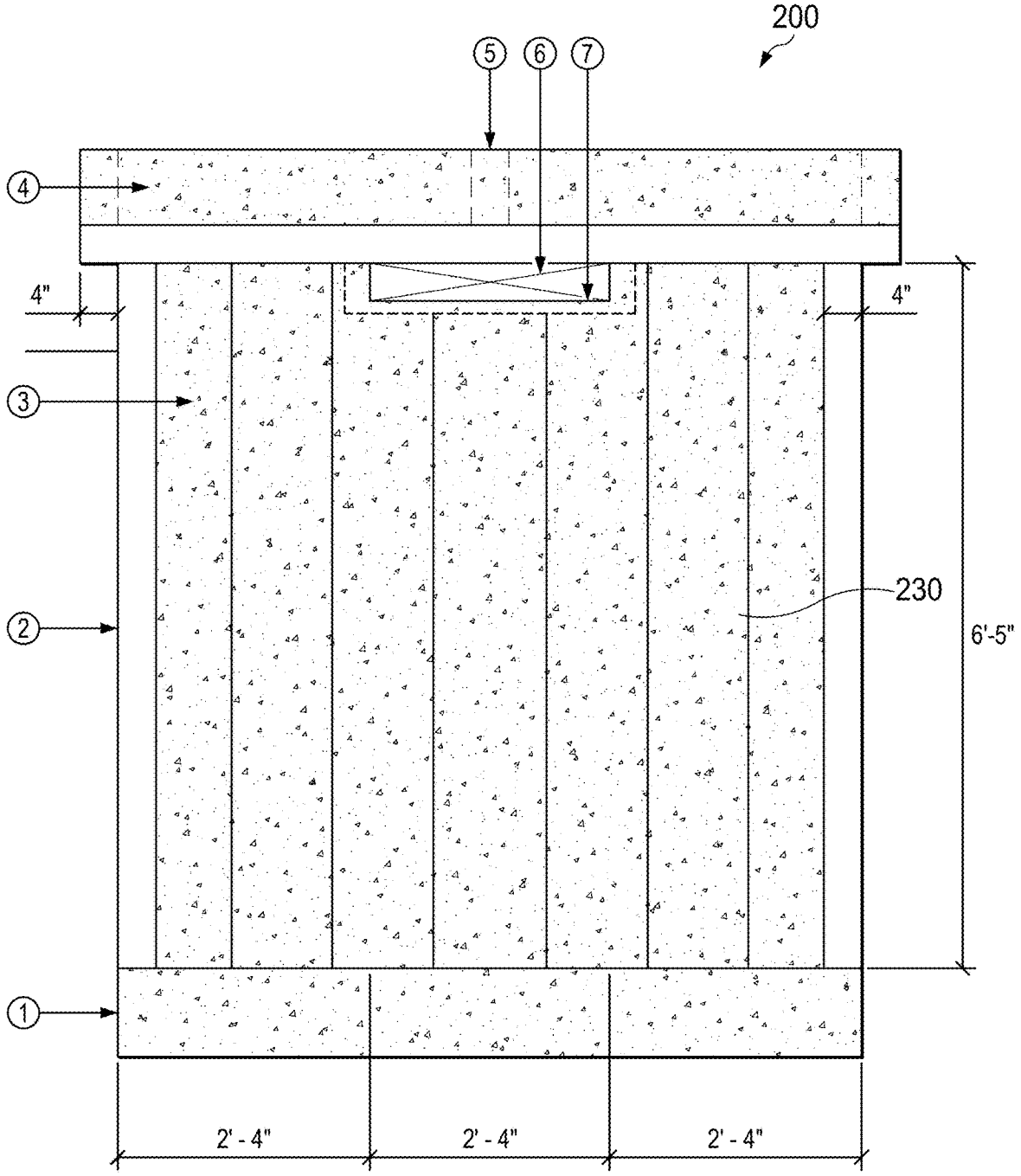
FIG. 13 is an elevation view of the shelter of FIG. 7 showing a vent opening formed in a wall.

Inside forms 220 are placed adjacent to inner angle iron 214. Outside forms 222 are placed adjacent to outer angle iron 216 (FIG. 9). Top ceiling form 224 is placed on a top surface of the inside forms 220. Rebar 216 is further bent to the center of the shelter 200 over top ceiling form 224.

A single pour of cement 230 is poured to deliver concrete between inside forms 220 and outside forms 222 and above top ceiling form 224. Inside forms 220 and top ceiling form 224 is preferably removed after cement 230 has cured.

Door 240 is preferably constructed with square tubing. Door 240 preferably has steel skin on an inside surface and an outside surface. Components of door 240 are layered and welded to a flat area in front to a doorway framed wall channel. All of the structure of door 240 is preferably welded together for strength. Preferably, door 240 swings to the inside of structure 200 and will be provided with two cross-door latch bars to lock door 240 in place.

In a preferred embodiment, shelter 200 has conduit 250 located cement 230 forming the walls and/or ceiling of shelter 200 for possible electric installations. Additionally, shelter 200 may be provided with vents 260, e.g., two 4" by 16" orifices for air ventilation. Shelter 200 is preferably provided with two welded benches located inside shelter 200.

In one embodiment, a method of constructing tornado shelter 200 includes placing base 210 at a desired location. Base 210 defines sides, corners and a center. Base 210 has outer angle iron 212 extending upwardly at each of the corners and inner angle iron 214 extending upwardly at each of the corners. Rods 216 are affixed extending upwardly from the sides of base 210. Inside concrete form 220 are placed adjacent inner angle iron 214. Inside concrete form 220 have a top surface. Outside concrete form 222 are placed adjacent outer angle iron 212. Outside concrete form 222 has a top surface. Rods 216 are between inside concrete form 220 and outside concrete form 222. Ceiling form 224 is placed on said top surface of inside concrete form 220. Support beams 226 are placed above ceiling form 224. An upper portion of rods 216 extend above the top surface of inside concrete form 220 and outside concrete form 222. The upper portion of rods 216 are bent towards the center of base 210 above support beams 226.

In one embodiment a single pour of concrete 230 is poured for filling a space between inside concrete form 220 and outside concrete form 222 and for covering the upper portion of rods 216 and support beams 226 above ceiling form 224. Inside concrete forms 220, outside concrete forms 222 and ceiling forms 224 are removed.

Door 240 may be hingedly affixed in a door opening in one of said walls. Conduit 250 is placed in a location selected from a group consisting of in between outside concrete form 222 and inside concrete form 220 and above ceiling form 224. Vents 260 may be formed in at least one of the walls. A bench may be affixed to base 210.

Referring now to FIGS. 15-18, shown is shelter 300 having walls 310 and roof section 320. Assembly 330 for constructing shelter 300 includes outside form 340 having inside facing surface 342, outside surface 344, and upper surface 346. Assembly 330 additionally includes a second outside form 350 having an upper surface 352. The second outside form 350 is placed to contact outside form 340 to create corner 358 (see, e.g., FIG. 18).

Figure 15:
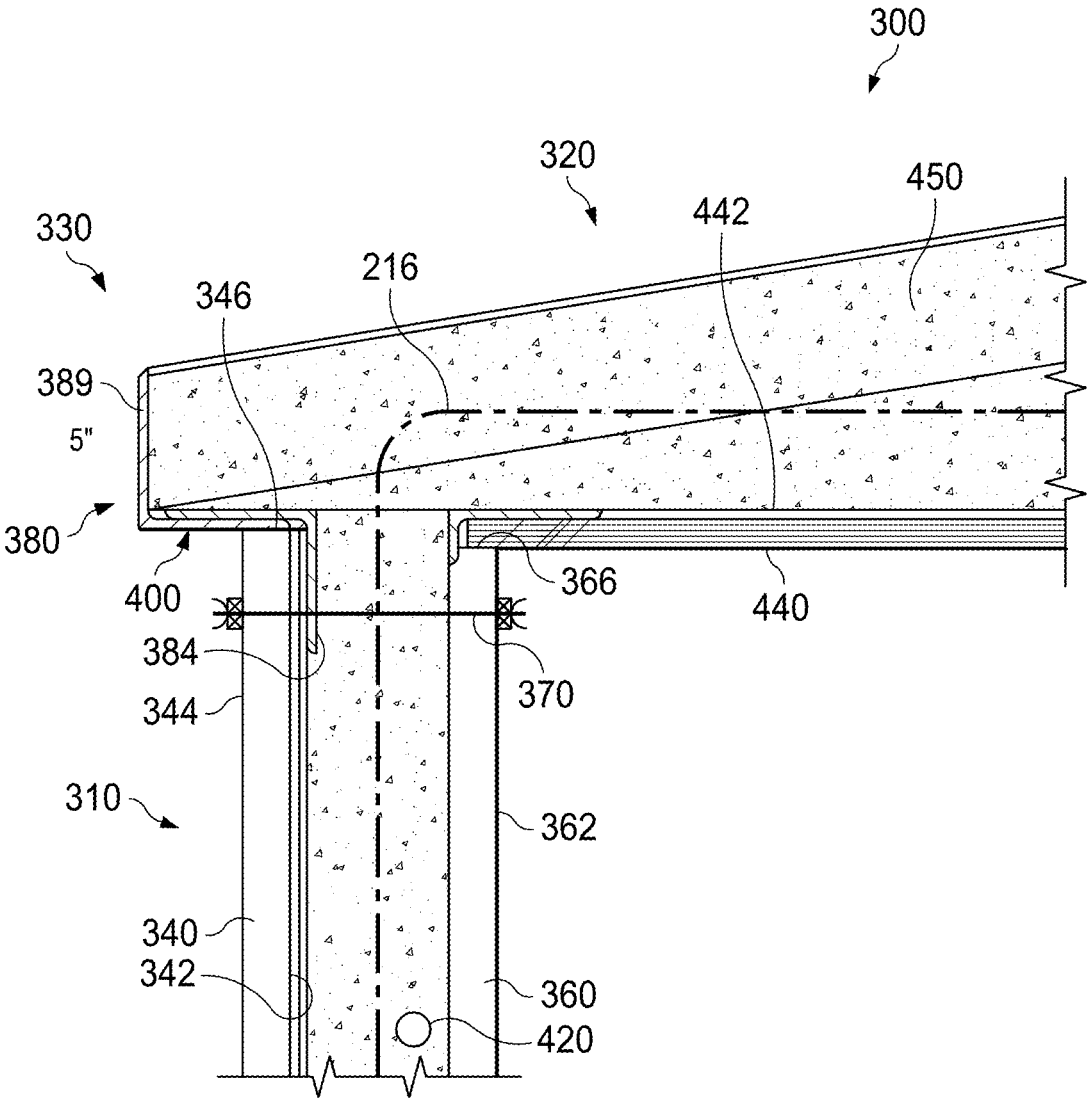
FIG. 15 is a cross-sectional elevation view of an intersection of a wall and roof portion with wall forms and a roof bracket installed.
Figure 16:
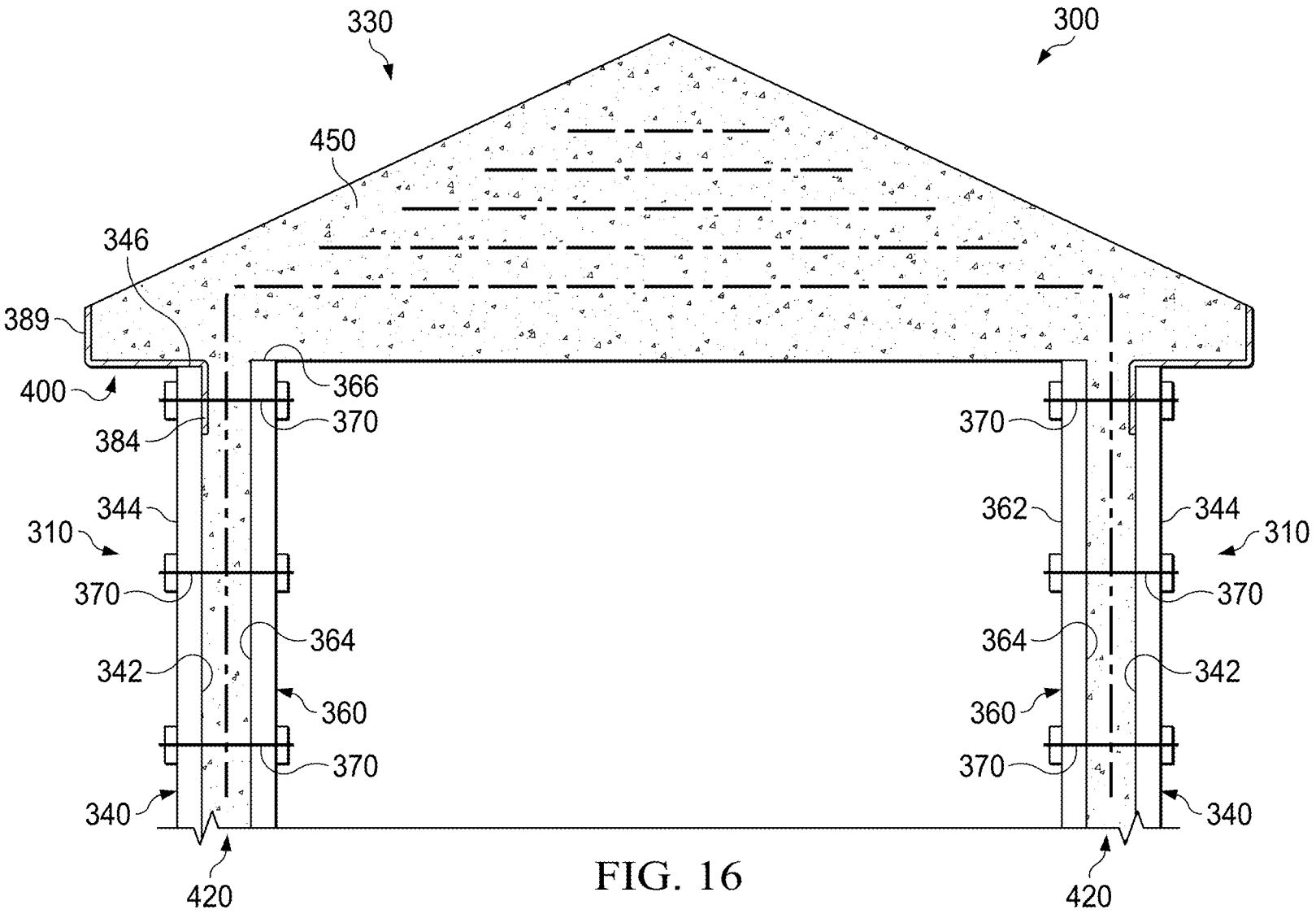
FIG. 16 is a cross-sectional elevation view of walls and roof section with snap ties installed for securing an inside wall form and an outside wall form.
Figure 17A:
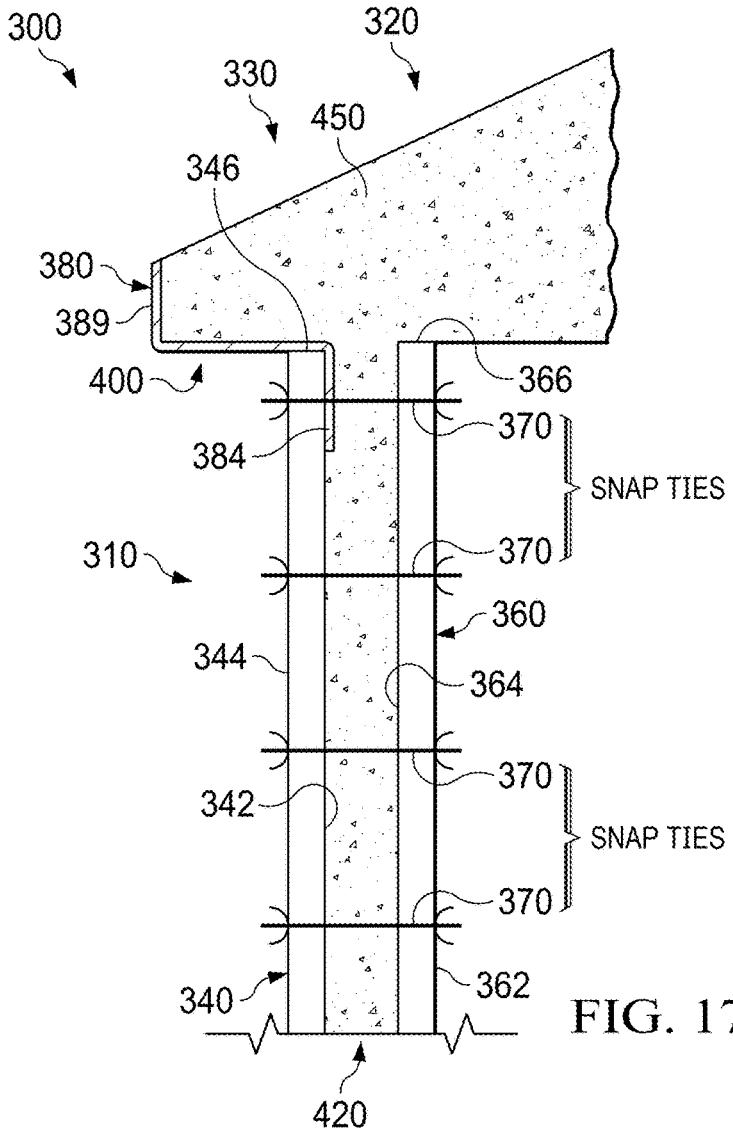
FIG. 17A is a cross-sectional elevation view of an intersection of a wall and roof portion with wall forms and a roof bracket installed with a plurality of snap ties installed for securing an inside wall form and an outside wall form.

Referring to FIGS. 15-17, inside form 360 is located adjacent to but spaced apart from outside form 350. Inside form 360 has inside facing surface 362, an outside facing surface 364, and an upper surface 366.

At least one fastener 370, such as a snap tie, spans between outside surface 344 of outside form 340 and inside facing surface 362 of inside form 360.

Figure 17B:
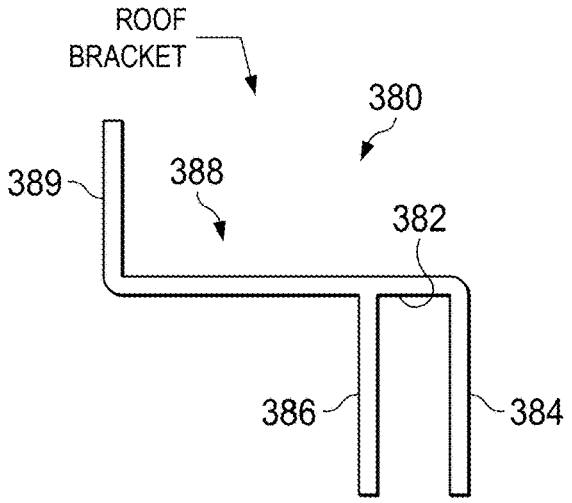
FIG. 17B is a cross-sectional view of the roof bracket of FIG. 17A.
Figure 17C:
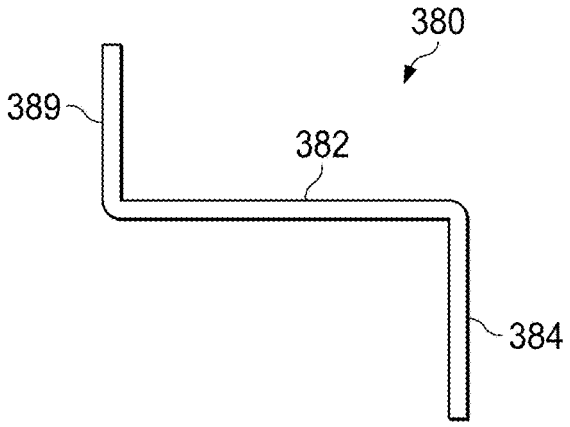
FIG. 17C is a cross-sectional view of an alternate embodiment of a roof bracket having a single downwardly extending portion.
Figure 18:
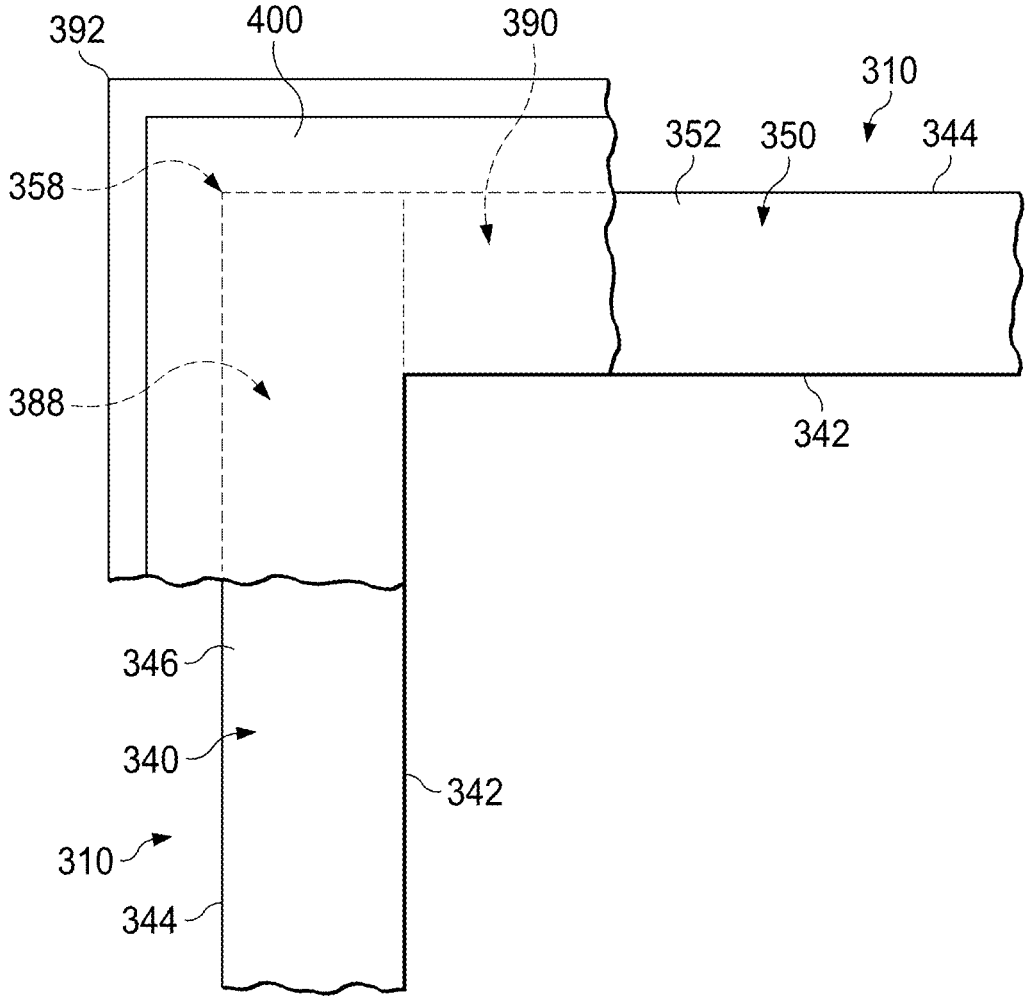
FIG. 18 is a plan view of the roof bracket of FIGS. 15-17 installed on an upper surface of walls at a corner formed by the walls.
Figure 19:
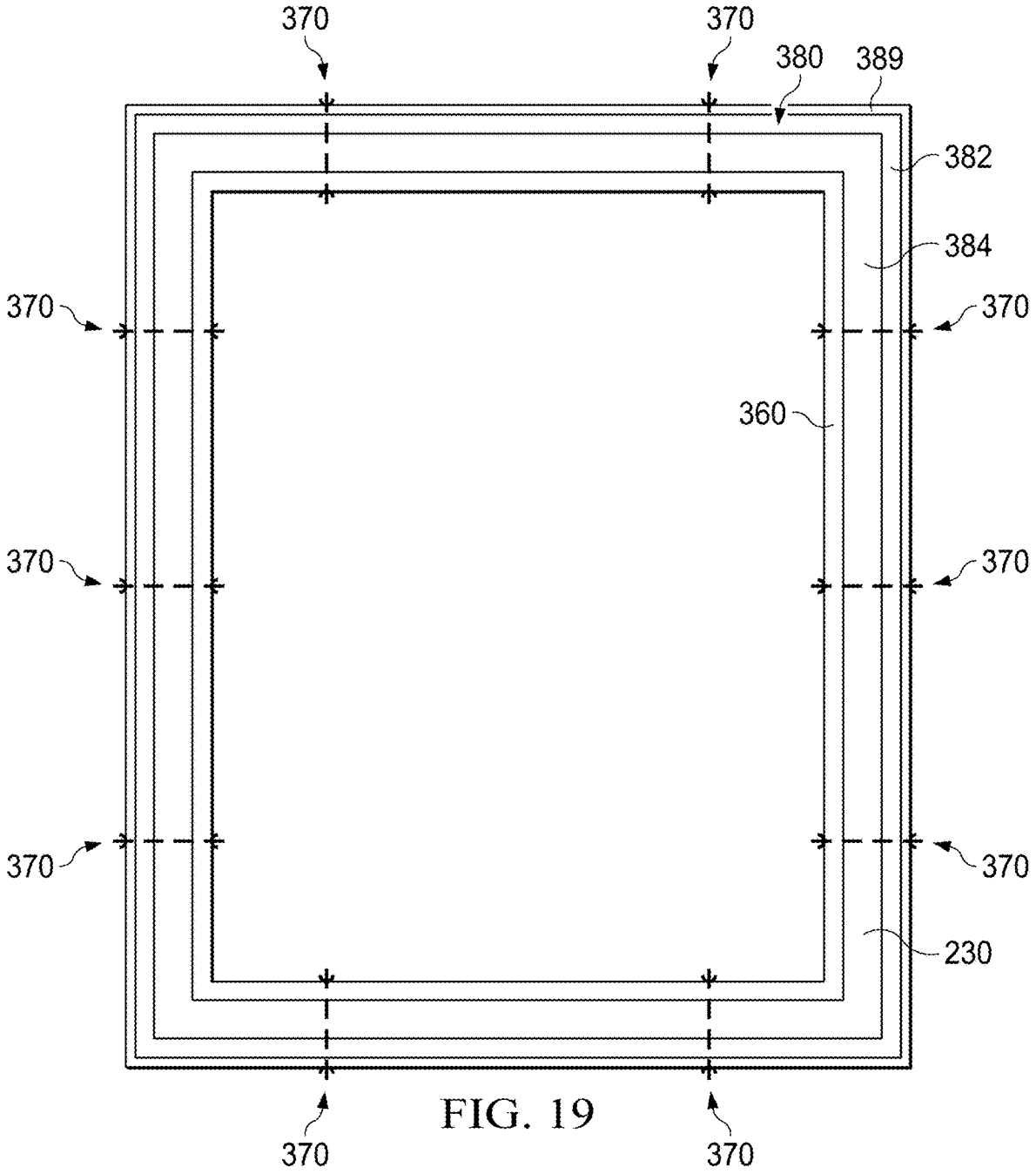
FIG. 19 is a plan view of the walls and roof bracket of FIGS. 17A-18 showing the roof bracket straddling and outside concrete form around the building.

Roof bracket 380 defines topping member 382 and internal downwardly extending portion 384 (see, e.g., FIG. 17C). Topping member 382 is preferably located on upper surface 346 of outside form 340. Internal downwardly extending portion 384 is placed adjacent to inside facing surface 342 of outside form 340. In one embodiment (FIG. 17C), roof bracket 380 additionally includes external downwardly extending portion 386 that extends from topping member 382. External downwardly extending portion 386 is preferably placed adjacent to outside surface 344 of outside form 340. In one embodiment, roof bracket 380 has first section 388 that covers a length of upper surface 346 of outside form 340. Roof bracket 380 may be provided with second section 390 (FIG. 18) that covers a length of upper surface 352 of second outside form 350. Roof bracket 380 may form a roof bracket corner 392 (FIG. 18) coinciding with corner 358 formed by outside form 340 and second outside form 350. Roof bracket 380 preferably straddles wall 310 all of the way around a building for creating a roof overhang.

In one embodiment, fastener 370 passes through internal downwardly extending portion 384 of roof bracket 380.

In practice, assembly 330 is used in a method of forming a roof overhang 400 of shelter 300. The method includes erecting inside concrete form 360 and erecting outside concrete form 340 adjacent to inside concrete form 360.

Shelter construction assembly 330 may be utilized to construct shelter 300 by using the following steps.

1. Erecting inside concrete form 360 having an inner surface 362, an outside facing surface 364, and an upper surface 366. Outside concrete form 340 is erected adjacent to and spaced apart from inside concrete form 360. Outside concrete form 340 has inner facing surface 342, outer surface 344, and an upper surface 346. Inner surface 364 of inside concrete form 360 and inner facing surface 342 of outside concrete form 340 define a space 420 therebetween. Space 420 will preferably be filled with concrete having a thickness of, e.g., 4".
2. Fasteners 370, such as snap ties, may be installed through inside concrete form 360 and through outside concrete form 340. In one embodiment, a fastener 370 is installed by passing fastener 370 through internal downwardly extending portion 384 of roof bracket 380.

Roof bracket 380 is located on upper surface 346 of outside concrete form 340. Roof bracket 380 defines topping member 382. External upwardly extending portion 389 extends upwardly from topping member 382 and internal downwardly extending portion 384 extends downwardly from topping member 382. In one embodiment, topping member 382 of roof bracket 380 is located on upper surface 346 of outside concrete form 340, wherein internal downwardly extending portion 384 is located adjacent to inner facing surface 342 of outside concrete form 340. FIG. 17B shows an enlarged view of roof bracket 380. Example dimensions include 4" for external upwardly extending portion 389 and 8" for internal downwardly extending portion 384.

Roof bracket 380 may also define external downwardly extending portion 386 wherein external downwardly extending portion 386 extends downwardly from topping member 382 of roof bracket 380. External downwardly extending portion 386 is positioned adjacent to outer surface 344 of outside concrete form 340. Top sealing form 440 (FIG. 15) may be affixed adjacent to upper surface 366 of inside concrete form 360. Top sealing form 440 additionally defines upper surface 442. Concrete 450 is poured onto upper surface 442 of top sealing form 440. Concrete 450 is retained on upper surface 442 by external upwardly extending portion 389 of roof bracket 380 for forming roof section 320.

In addition to any previously indicated modification, numerous other variations and alternative arrangements can be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use can be made without departing from the principles and concepts set forth herein. Also, as used herein, examples are meant to be illustrative only and should not he construed to he limiting in any manner.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

What is claimed is:

1. A shelter construction assembly comprising:

an outside form having an inside facing surface, an outside surface, and an upper surface;

a roof bracket defining a topping member and an internal downwardly extending portion, wherein said topping member is located on said upper surface of said outside form, said internal downwardly extending portion adjacent to said inside facing surface of said outside form;

an external downwardly extending portion extending from said topping member, said external downwardly extending portion adjacent to said outside surface of said outside form.

2. The shelter according to claim 1 further comprising:

a second outside form having an upper surface, said second outside form contacting said outside form to create a corner;

wherein said roof bracket has a first section that covers a length of said upper surface of said outside form, said roof bracket having a second section that covers a length of said upper surface of said second outside form, said roof bracket forming a roof bracket corner coinciding with said corner.

3. The shelter according to claim 1 further comprising:

an inside form located adjacent to said outside form, said inside form having an inside facing surface, an outside facing surface, and an upper surface;

at least one fastener spanning between said outside surface of said outside form and said inside facing surface of said inside form.

4. The shelter according to claim 3 wherein:

said fastener passes through said internal downwardly extending portion of said roof bracket.

5. The shelter according to claim 4 wherein said fastener is a snap tie.

6. A method of forming a roof overhang of a shelter comprising the steps of:

erecting an inside concrete form having an inner surface, an outside facing surface, and an upper surface;

erecting an outside concrete form adjacent to said inside concrete form, said outside concrete form having an inner facing surface, an outer surface, and an upper surface;

wherein said inner surface of said inside concrete form and said inner facing surface of said outside concrete form define an space therebetween;

locating a roof bracket on said upper surface of said outside concrete form, said roof bracket defining a topping member, an external upwardly extending portion affixed to said topping member and an internal downwardly extending portion affixed to said topping member, wherein said topping member of said roof bracket is located on said upper surface of said outside concrete form, said internal downwardly extending portion adjacent to said inner facing surface of said outside concrete form;

locating a top ceiling form adjacent to said upper surface of said inside concrete form, said top ceiling form defining an upper surface;

pouring concrete on said upper surface of said top ceiling form and retaining said concrete with said external upwardly extending portion of said roof bracket for forming the roof overhang;

said roof bracket defines an external downwardly extending portion, said external downwardly extending portion extending from said topping member of said roof bracket, said external downwardly extending portion positioned adjacent to said outer surface of said outside concrete form.

7. The method according to claim 6 further comprising a step of:

installing a fastener though said inside concrete form and said outside concrete form.

8. The method to claim 7 wherein:

said step of installing said fastener includes passing said fastener through said internal downwardly extending portion of said roof bracket.

9. The method according to claim 8 wherein said fastener is a snap tie.

10. A shelter construction assembly comprising:

an outside form having an inside facing surface, an outside surface, and an upper surface;

a roof bracket defining a topping member and an internal downwardly extending portion, wherein said topping member is located on said upper surface of said outside form, said internal downwardly extending portion adjacent to said inside facing surface of said outside form;

a second outside form having an upper surface, said second outside form contacting said outside form to create a corner;

wherein said roof bracket has a first section that covers a length of said upper surface of said outside form, said roof bracket having a second section that covers a length of said upper surface of said second outside form, said roof bracket forming a roof bracket corner coinciding with said corner.

11. The method according to claim 10 wherein:

an external downwardly extending portion extending from said topping member, said external downwardly extending portion adjacent to said outside surface of said outside form.

* * * * *